US010229627B2

(12) United States Patent
Bian et al.

(10) Patent No.: US 10,229,627 B2
(45) Date of Patent: Mar. 12, 2019

(54) CONTROLLING A REFRESH FREQUENCY FOR A DISPLAY DRIVING DEVICE AND METHODS OF OPERATION THEREOF

(71) Applicants: Boe Technology Group Co., Ltd., Beijing (CN); Beijing Boe Optoelectronics Technology Co., Ltd., Beijing (CN)

(72) Inventors: Qingfang Bian, Beijing (CN); Xue Dong, Beijing (CN); Dong Chen, Beijing (CN); Hao Zhang, Beijing (CN); Lingyun Shi, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 22 days.

(21) Appl. No.: 15/105,678

(22) PCT Filed: Jan. 7, 2016

(86) PCT No.: PCT/CN2016/070388

§ 371 (c)(1),
(2) Date: Jun. 17, 2016

(87) PCT Pub. No.: WO2017/012301

PCT Pub. Date: Jan. 26, 2017

(65) Prior Publication Data

US 2017/0206823 A1 Jul. 20, 2017

(30) Foreign Application Priority Data

Jul. 21, 2015 (CN) ..... 2015 1 0432038

(51) Int. Cl.

| | |
|---|---|
| ***G09G 3/20*** | (2006.01) |
| ***G09G 5/00*** | (2006.01) |
| ***G09G 5/18*** | (2006.01) |

(52) U.S. Cl.
CPC ..... *G09G 3/2092* (2013.01); *G09G 5/00* (2013.01); *G09G 5/003* (2013.01); *G09G 5/18* (2013.01);
(Continued)

(58) Field of Classification Search
CPC ..... G09G 2320/0247; G09G 2340/0435
See application file for complete search history.

(56) References Cited

U.S. PATENT DOCUMENTS

| | | | |
|---|---|---|---|
| 5,555,460 | A | 9/1996 | Ericsson |
| 7,330,191 | B2 | 2/2008 | Bhattacharjya |

(Continued)

FOREIGN PATENT DOCUMENTS

| | | |
|---|---|---|
| CN | 101331760 | 12/2008 |
| CN | 101465096 A | 6/2009 |

(Continued)

OTHER PUBLICATIONS

Office action from Chinese Application No. 201510432038.0 dated Mar. 9, 2017.

(Continued)

*Primary Examiner* — Sepehr Azari
(74) *Attorney, Agent, or Firm* — Calfee, Halter & Griswold LLP

(57) ABSTRACT

Embodiments of the disclosure provide a display driving device including: a counting unit configured to count the number of first pixel points whose gray level values are larger than or equal to a first gray level value and the number of the other pixel points whose gray level values are smaller than the first gray level value in an image displayed by a target display, a comparing unit configured to compare the number of the first pixel points and the number of the other pixel points and transmit a first instruction to the driving unit if the former is larger than or equal to the latter, and a driving (Continued)

unit configured to control a refresh frequency of the display to be larger than or equal to a first frequency if the first instruction is received, otherwise, control the refresh frequency of the display to be smaller than the first frequency.

17 Claims, 2 Drawing Sheets

(52) U.S. Cl.
CPC ..... *G09G 2330/021* (2013.01); *G09G 2340/0435* (2013.01); *G09G 2360/16* (2013.01)

(56) References Cited

U.S. PATENT DOCUMENTS

| | | | | |
|---|---|---|---|---|
| 8,928,641 | B2 | 1/2015 | Chiu et al. | |
| 2008/0049006 | A1 | 2/2008 | Yi et al. | |
| 2009/0160880 | A1* | 6/2009 | Park | G09G 3/3233 345/690 |
| 2012/0069030 | A1 | 3/2012 | Shang | |
| 2015/0179097 | A1 | 6/2015 | Derekx et al. | |
| 2015/0287352 | A1* | 10/2015 | Watanabe | G09G 3/20 345/89 |
| 2016/0093239 | A1* | 3/2016 | Wang | G06F 1/32 345/55 |

FOREIGN PATENT DOCUMENTS

| | | | |
|---|---|---|---|
| CN | 201315147 | | 9/2009 |
| CN | 101894513 | | 11/2010 |
| CN | 101937643 | A | 1/2011 |
| CN | 101950534 | A | 1/2011 |
| CN | 103325332 | A | 9/2013 |
| CN | 104269155 | A | 1/2015 |
| CN | 104933986 | | 9/2015 |
| JP | 2015094954 | | 5/2015 |
| TW | 201113864 | | 4/2011 |

OTHER PUBLICATIONS

Second Office Action for Chinese Patent Application No, 201510432038.0 dated Jul. 13, 2017.

Yuan Sheng-chun et al,, "The Factors Influence of Indoor LED Display Subjective Assessment", School of Technical Physics, Xidain University, Xi'an Shaanxi, China, Advanced Display, Sep. 2012, pp. 117-120.

Lin, Zhong-xian et al/. Vision, Color Measurements and Applications, Jun. 1987, pp. 10-13—printing in Beijing, China.

International Search Report and Written Opinion from PCT/CN16/070388 dated Apr. 7, 2016.

Third Office Action for Chinese Application No. 201510432038.0 dated Dec. 22, 2017.

Fourth Action for Chinese Application No. 201510432038.0 dated May 9, 2018.

* cited by examiner

CONTROLLING A REFRESH FREQUENCY FOR A DISPLAY DRIVING DEVICE AND METHODS OF OPERATION THEREOF

RELATED APPLICATIONS

The present application is the U.S. national phase entry of PCT/CN2016/070388, with an international filing date of Jan. 7, 2016, which claims the benefit of Chinese Patent Application No. 201510432038.0, filed Jul. 21, 2015, the entire disclosures of which are incorporated herein by reference.

TECHNICAL FIELD

The present disclosure relates to the field of display technology, particularly to a display driving device, a display device and a method of operating a display driving device.

BACKGROUND

With development of display technology and increase of user requirement, the requirements on display design and display quality becomes higher and higher. The increased display effects cause corresponding problems. One such problem is power consumption. For terminals such as mobile phones and tablet computers which rely on battery power to work, the power consumption problem is more evident.

SUMMARY

Therefore, it is desired to reduce the power consumption of a display.

For this purpose, the present disclosure proposes a display driving device, comprising: a counting unit, a comparing unit and a driving unit, wherein the counting unit is configured to count the number of first pixel points whose gray level values are larger than or equal to a first gray level value and the number of other pixel points whose gray level values are smaller than the first gray level value in an image displayed by a target display;

the comparing unit is configured to compare the number of the first pixel points and the number of the other pixel points, and transmit a first instruction to the driving unit if the number of the first pixel points is larger than or equal to the number of the other pixel points;

the driving unit is configured to, if the first instruction is received, control a refresh frequency of the target display to be larger than or equal to a first frequency, otherwise, control the refresh frequency of the target display to be smaller than the first frequency.

According to another embodiment of the present disclosure, the counting unit is further configured to count the number of second pixel points whose gray level values are smaller than the first gray level value and larger than or equal to a second gray level value, the number of third pixel points whose gray level values are smaller than the second gray level value and larger than or equal to a third gray level value, . . . , and the number of Nth pixel points whose gray level values are smaller than a N−1th gray level value and larger than or equal to a Nth gray level value;

the comparing unit is further configured to compare the numbers of the first to Nth pixel points, and transmit a nth instruction to the driving unit if the number of nth pixel points is the largest in the numbers of the first to the Nth pixel points;

the driving unit is further configured to, if the nth instruction is received, control the target display to be refreshed at a nth frequency, wherein n and N are positive integers, and $1<n\leq N$, $N>1$, the n−1th frequency is larger than the nth frequency.

According to another embodiment of the present disclosure, a difference value between the n−1th frequency and the nth frequency is larger than or equal to a difference value between the nth frequency and the n+1th frequency.

According to another embodiment of the present disclosure, N=4, the first gray level value is larger than 190 and smaller than 200, the second gray level value is larger than 120 and smaller than 130, the third gray level value is larger than 60 and smaller than 70.

According to another embodiment of the present disclosure, the first gray level value is equal to 192, the second gray level value is equal to 127, and the third gray level value is equal to 63, and a first refresh frequency is equal to 60 Hz, a second refresh frequency is equal to 50 Hz, a third refresh frequency is equal to 42 Hz, and a fourth refresh frequency is equal to 36 Hz.

According to another embodiment of the present disclosure, N=3, the first gray level value is larger than 190 and smaller than 200, and the second gray level value is larger than 120 and smaller than 130.

According to another embodiment of the present disclosure, the first gray level value is equal to 192, and the second gray level value is equal to 127, and a first refresh frequency is equal to 60 Hz, a second refresh frequency is equal to 50 Hz, and a third refresh frequency is equal to 42 Hz.

According to another embodiment of the present disclosure, N=2, the first gray level value is larger than 190 and smaller than 200.

According to another embodiment of the present disclosure, the first gray level value is equal to 192, and a first refresh frequency is equal to 60 Hz.

According to another embodiment of the present disclosure, the counting unit counts the number of the first pixel points whose gray level values are larger than or equal to the first gray level value and the number of the other pixel points whose gray level values are smaller than the first gray level value in the image displayed by the target display in a preset period.

According to another embodiment of the present disclosure, the display driving device further comprises:

a frequency selecting unit for setting a refresh frequency of the target display.

The present disclosure further proposes a display device, comprising a display panel and the above display driving device.

The present disclosure further proposes a method of operating a display driving device, comprising:

counting the number of first pixel points whose gray level values are larger than or equal to a first gray level value and the number of other pixel points whose gray level values are smaller than the first gray level value in an image displayed by a target display;

comparing the number of the first pixel points and the number of the other pixel points, and generating a first instruction if the number of the first pixel points is larger than or equal to the number of the other pixel points;

controlling a refresh frequency of the target display to be larger than or equal to a first frequency if the first instruction is generated, otherwise, controlling the refresh frequency of the target display to be smaller than the first frequency.

According to another embodiment of the present disclosure, the method of operating a display driving device further comprises:

counting the number of second pixel points whose gray level values are smaller than the first gray level value and larger than or equal to a second gray level value, the number of third pixel points whose gray level values are smaller than the second gray level value and larger than or equal to a third gray level value, . . . , and the number of Nth pixel points whose gray level values are smaller than a N−1th gray level value and larger than or equal to a Nth gray level value;

comparing the numbers of the first to Nth pixel points, and generating a nth instruction if the number of nth pixel points is the largest in the numbers of the first to the Nth pixel points;

controlling the target display to be refreshed at a nth frequency if the nth instruction is generated, wherein n and N are positive integers, and $1<n\leq N$, $N>1$, the n−1th frequency is larger than the nth frequency.

According to another embodiment of the present disclosure, a difference value between the n−1th frequency and the nth frequency is larger than or equal to a difference value between the nth frequency and the n+1th frequency.

According to another embodiment of the present disclosure, counting the number of first pixel points whose gray level values are larger than or equal to a first gray level value and the number of other pixel points whose gray level values are smaller than the first gray level value in an image displayed by a target display comprises:

counting the number of the first pixel points whose gray level values are larger than or equal to the first gray level value and the number of the other pixel points whose gray level values are smaller than the first gray level value in the image displayed by the target display in a preset period.

According to another embodiment of the present disclosure, the method of operating a display driving device further comprises:

setting a refresh frequency of the target display.

Through the above technical solution, the refresh frequency of the display device can be reduced in the case of almost not influencing the viewing effect of the user, thereby reducing the power consumption of the display.

BRIEF DESCRIPTION OF THE DRAWINGS

The characteristics and advantages of the present disclosure will be understood more clearly by making reference to the drawings. The drawings are schematic and should not be understood as any limitations to the present disclosure, in the drawings.

DETAILED DESCRIPTION OF THE DISCLOSURE

In order to understand the above purposes, characteristics and advantages of the present disclosure more clearly, the present disclosure will be described in more detail with reference to the drawings and specific embodiments in the following. It should be noted that the embodiments and the features in the embodiments of the present application can be combined with one another so long as they do not conflict with one another.

Many specific details are elaborated in the following for the convenience of sufficiently understanding the present disclosure. However, the present disclosure can also be implemented using other manners different from those described here. Hence, the scope of protection of the present disclosure is not limited by the specific embodiments disclosed below.

Figure 1:
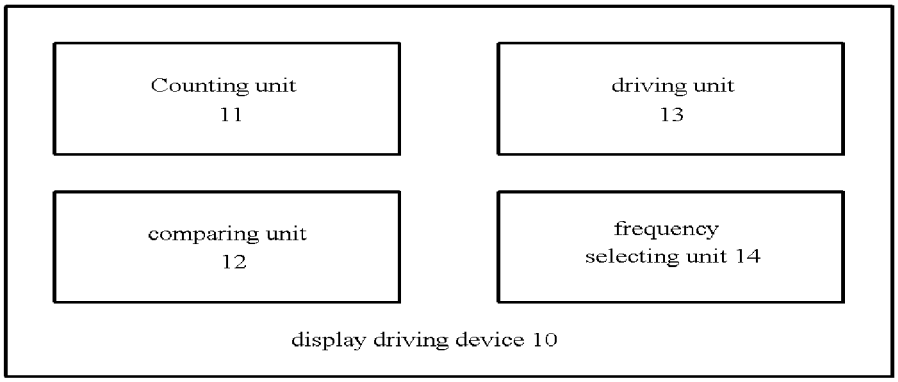
FIG. 1 shows a schematic block diagram of a display driving device according to an embodiment of the present disclosure.

As shown in FIG. 1, a display driving device 10 according to an embodiment of the present disclosure comprises: a counting unit 11, a comparing unit 12 and a driving unit 13.

The counting unit 11 is configured to count the number of first pixel points whose gray level values are larger than or equal to a first gray level value and the number of other pixel points whose gray level values are smaller than the first gray level value in an image displayed by a target display;

the comparing unit 12 is configured to compare the number of the first pixel points and the number of the other pixel points, and transmit a first instruction to the driving unit 13 if the number of the first pixel points is larger than or equal to the number of the other pixel points;

the driving unit 13 is configured to, if the first instruction is received, control a refresh frequency of the target display to be larger than or equal to a first frequency, otherwise, control the refresh frequency of the target display to be smaller than the first frequency.

The human eyes have relatively high sensitivity to the refresh interval of an image with a relatively high gray level value, and have relatively low sensitivity to refresh interval of an image with a relatively low gray level value. Thus, in an image displayed by a target display, when the pixel points with relatively high gray level values (i.e., the first pixel points) are more than the pixel points with relatively low gray level values (i.e., other pixel points), it can be determined that the image is an image with a relatively high gray level value, thereby the target display can be controlled to be refreshed at a relatively high frequency (i.e., a frequency larger than or equal to a first frequency), so that the refresh interval of the image is relatively short, so as to ensure the viewing effect of a user.

Correspondingly, if the pixel points with relatively high gray level values are less than the pixel points with relatively low gray level values, it can be determined that the image is an image with a relatively low gray level value, thereby the target display can be controlled to be refreshed at a relatively low frequency (i.e., a frequency smaller than the first frequency). Thus, the refresh frequency is reduced in the case of almost not influencing the viewing effect of the user, thereby reducing the power consumption of the target display. For terminals such as mobile phones and tablet computers which rely on battery for power supply, the electric energy saving effect is particularly evident, and the endurance ability thereof can be significantly improved.

According to another embodiment of the present disclosure, the counting unit 11 is further configured to count the number of second pixel points whose gray level values are smaller than the first gray level value and larger than or equal to a second gray level value, the number of third pixel points whose gray level values are smaller than the second gray level value and larger than or equal to a third gray level value, . . . , and the number of Nth pixel points whose gray level values are smaller than a N−1th gray level value and larger than or equal to a Nth gray level value;

the comparing unit 12 is further configured to compare the numbers of the first to Nth pixel points, and transmit a nth instruction to the driving unit 13 if the number of nth pixel points is the largest in the numbers of the first to the Nth pixel points;

the driving unit 13 is further configured to, if the nth instruction is received, control the target display to be refreshed at a nth frequency, wherein n and N are positive integers, and $1<n\leq N$, $N>1$, the n−1th frequency is larger than the nth frequency.

Although the human eyes have relatively low sensitivity to the refresh interval of an image with a relatively low gray level value, they are more sensitive to persistence of vision caused by change of the gray level value (for example the difference between the gray level values of two adjacent frames of image) of an image with a relatively low gray level value when the refresh frequency is unchanged relative to persistence of vision caused by change of the gray level value of an image with a relatively high gray level value when the refresh frequency is unchanged.

In the event that the refresh frequency is constant, for the case that the gray level value of the image is relatively high, it is not easy for the human eyes to perceive the change of the gray level value, while for the case that the gray level value of the image is relatively low, it is easy for the human eyes to perceive the change of the gray level value. For example, if the gray level value is changed from 233 to 193, the change amount is −40, it is not easy for the human eyes to perceived the change of the gray level value. If the gray level value is changed from 130 to 90, the change amount is also −40, but it is easy for the human eyes to perceive the change of the gray level value.

Therefore, if other pixel points whose gray level values are smaller than the first gray level values are classified into one type of pixel points and the display is refreshed at a relatively low frequency when there are much more this type of pixel points in the image displayed by the display, although the power consumption of the display can be reduced noticeably, the viewing effect of the user will also be influenced to some extent.

According to this embodiment, the other pixel points whose gray level values are less than the first gray level value are classified further, and corresponding refresh frequencies can be set respectively when the target display displays images with different gray level values, thereby being capable of reducing the refresh frequency gradually with the decrease of the gray level value of the image, rather than setting a very low refresh frequency directly. Thus, it can ensure that it is not easily perceived by the user when the gray level value of the image with a relatively low gray level value is changed, thereby ensuring the viewing effect of the user while reducing the power consumption of the display.

According to another embodiment of the present disclosure, a difference value between the n−1th frequency and the nth frequency is larger than or equal to a difference value between the nth frequency and the n+1th frequency. Since the user is more sensitive to change of the gray level value of an image with a relatively low gray level value relative to change of the gray level value of an image with a relatively high gray level value, with the decrease of the gray level value of the image, the difference value between the refresh frequencies can be reduced gradually while reducing the refresh frequency gradually.

For example, N=4, the first refresh frequency is equal to 60 Hz, the second refresh frequency is equal to 50 Hz, the difference value between the two is 10 Hz. When a third refresh frequency is set, the difference value between the second refresh frequency and the third refresh frequency can be made smaller than 10 Hz, e.g., the difference value is 8 Hz, then the third refresh frequency can be set to be equal to 42 Hz. Correspondingly, in order to ensure that the difference value between the third refresh frequency and the fourth refresh frequency is smaller than 8 Hz, e.g., the difference value is 6 Hz, the fourth refresh frequency can be set to be equal to 36 Hz.

Thus, it ensures that the image can still be refreshed at a refresh frequency that is not too low when the gray level value of the image displayed by the display is relatively low, thereby reducing the influence of the persistence of vision to the viewing effect, so as to further ensure the viewing effect of the user.

According to another embodiment of the present disclosure, N=4, the first gray level value is larger than 190 and smaller than 200, the second gray level value is larger than 120 and smaller than 130, and the third gray level value is larger than 60 and smaller than 70.

According to another embodiment of the present disclosure, the first gray level value is equal to 192, the second gray level value is equal to 127, and the third gray level value is equal to 63, and a first refresh frequency is equal to 60 Hz, a second refresh frequency is equal to 50 Hz, a third refresh frequency is equal to 42 Hz, and a fourth refresh frequency is equal to 36 Hz.

The human eyes are not sensitive to change of the gray level value of the pixel points whose gray level values are larger than 192 when the refresh frequency is unchanged, and are sensitive to change of the gray level value of the pixel points whose gray level values are smaller than 192 when the refresh frequency is unchanged. Further, they are more sensitive to change of the gray level value of the pixel points whose gray level values are below 127 when the refresh frequency is unchanged, and most sensitive to change of the gray level value of the pixel points whose gray level values are below 63 when the refresh frequency is unchanged. Hence, the pixel points whose gray level values are less than 192 can be classified further so that change of the gray level values of the pixel points of the image can be avoided from being perceived by the user and the power consumption of the target display can be reduced when the gray level values of the pixel points of the image are changed.

According to another embodiment of the present disclosure, N=3, the first gray level value is larger than 190 and smaller than 200, and the second gray level value is larger than 120 and smaller than 130.

According to another embodiment of the present disclosure, the first gray level value is equal to 192, and the second gray level value is equal to 127. A first refresh frequency is equal to 60 Hz, a second refresh frequency is equal to 50 Hz, and a third refresh frequency is equal to 42 Hz.

According to another embodiment of the present disclosure, N=2, the first gray level value is larger than 190 and smaller than 200.

According to another embodiment of the present disclosure, the first gray level value is equal to 192, and a first refresh frequency is equal to 60 Hz.

The above embodiments illustrate the gray level value settings and the corresponding refresh frequencies in the three cases of N=2, N=3 and N=4. The value of N can be set as needed in practice, and the refresh frequencies to which different gray level values correspond can also be set as needed.

According to another embodiment of the present disclosure, the counting unit 11 counts the number of the first pixel points whose gray level values are larger than or equal to the first gray level value and the number of the other pixel points whose gray level values are smaller than the first gray level value in the image displayed by the target display in a preset period.

Counting the number of the first pixel points and the number of other pixel points in a preset period can avoid consumption of electricity caused by the counting unit 11 counting the number of the pixel points with different gray level values frequently to change the refresh frequency frequently when the gray level value of the image displayed by the target display varies frequently. Certainly, in order to improve visual experience of the user, the preset period can be set relatively short, e.g., 0.5 seconds.

According to another embodiment of the present disclosure, the display driving device 10 can further comprise: a frequency selecting unit 14 for setting a refresh frequency of the target display.

Since different users have different sensitivities to the refresh frequency of an image, the refresh frequency of the target display can be set based on specific requirements.

An embodiment of the present disclosure further proposes a display device, comprising a display panel and the above display driving device. The display driving device is used for driving the display panel.

It should be noted that the display device in this embodiment can be any product or component with the display function such as electronic paper, a mobile phone, a tablet computer, a television, a laptop, a digital photo frame, a navigator etc.

Figure 2:
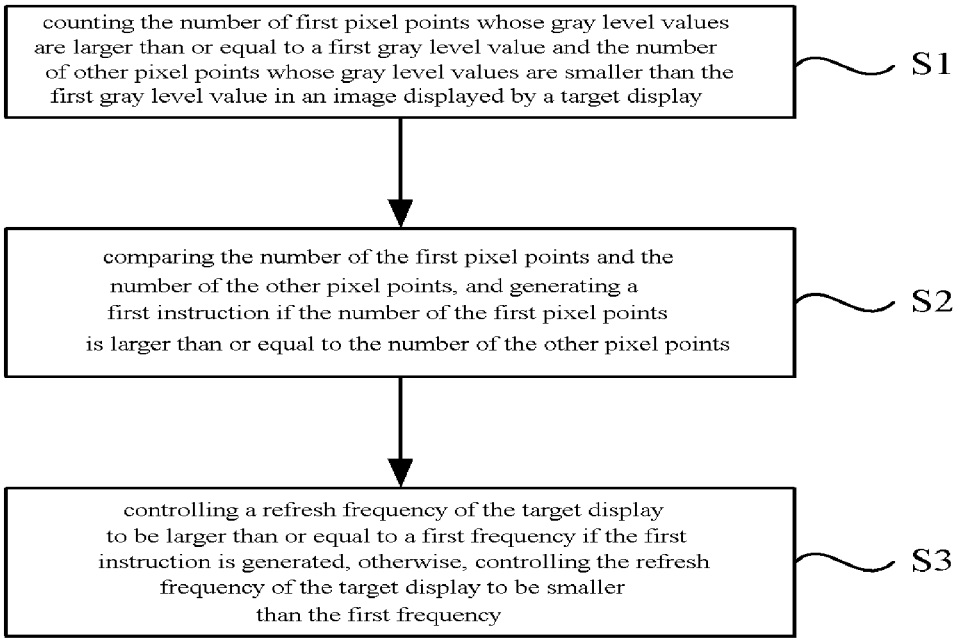
FIG. 2 shows a schematic flow chart of a method of operating a display driving device according to an embodiment of the present disclosure.

As shown in FIG. 2, the method of operating a display driving device according to an embodiment of the present disclosure can comprise:

S1. counting the number of first pixel points whose gray level values are larger than or equal to a first gray level value and the number of other pixel points whose gray level values are smaller than the first gray level value in an image displayed by a target display;

S2. comparing the number of the first pixel points and the number of the other pixel points, and generating a first instruction if the number of the first pixel points is larger than or equal to the number of the other pixel points;

S3. controlling a refresh frequency of the target display to be larger than or equal to a first frequency if the first instruction is generated, otherwise, controlling the refresh frequency of the target display to be smaller than the first frequency.

According to another embodiment of the present disclosure, the method of operating a display driving device can further comprise:

counting the number of second pixel points whose gray level values are smaller than the first gray level value and larger than or equal to a second gray level value, the number of third pixel points whose gray level values are smaller than the second gray level value and larger than or equal to a third gray level value, . . . , and the number of Nth pixel points whose gray level values are smaller than a N−1th gray level value and larger than or equal to a Nth gray level value;

comparing the numbers of the first to Nth pixel points, and generating a nth instruction if the number of nth pixel points is the largest in the numbers of the first to the Nth pixel points;

controlling the target display to be refreshed at a nth frequency if the nth instruction is generated, wherein n and N are positive integers, and $1<n\leq N$, $N>1$, the n−1th frequency is larger than the nth frequency.

Figure 3:
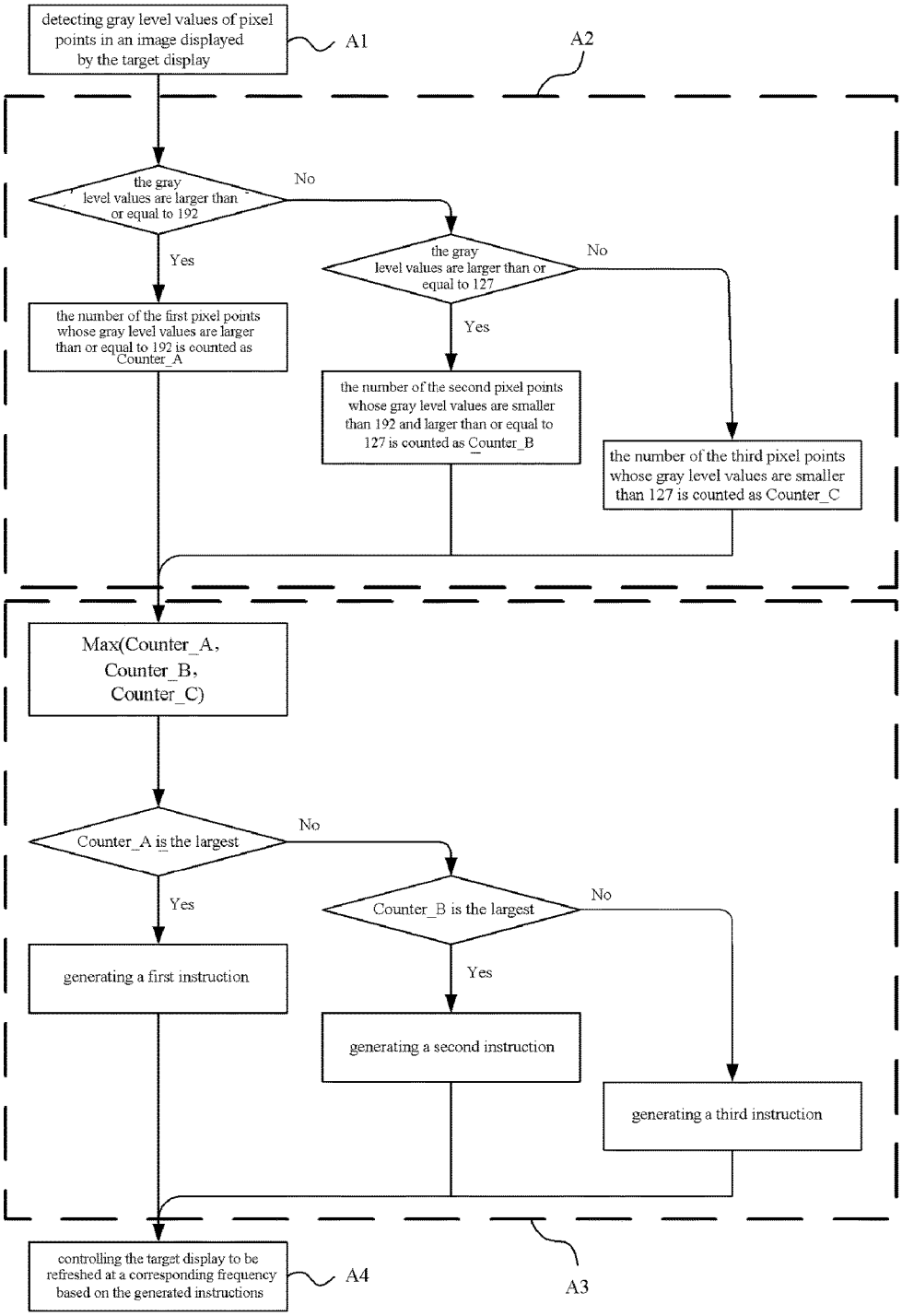
FIG. 3 shows a schematic flow chart of the method of operating a display driving device in the case of N=3.

For example, as shown in FIG. 3, in the even that N=3, the first gray level value is equal to 192, and the second gray level value is equal to 127, the method of operating a display driving device can comprise:

A1. detecting gray level values of pixel points in an image displayed by the target display;

A2. counting the number Counter_A of the first pixel points whose gray level values are larger than or equal to 192, the number Counter_B of the second pixel points whose gray level values are less than 192 and larger than or equal to 127, and the number Counter_C of the third pixel points whose gray level values are less than 127 in the image displayed by the target display;

A3. comparing Counter_A, Counter_B and Counter_C, generating a first instruction if Counter_A is the largest, generating a second instruction if Counter_B is the largest, and generating a third instruction if Counter_C is the largest, the first to third instructions contain frequency information;

A4. controlling the target display to be refreshed at a frequency of 60 Hz if the first instruction is generated, controlling the target display to be refreshed at a frequency of 50 Hz if the second instruction is generated, and controlling the target display to be refreshed at a frequency of 42 Hz if the third instruction is generated.

According to another embodiment of the present disclosure, a difference value between the n−1th frequency and the nth frequency is larger than or equal to a difference value between the nth frequency and the n+1th frequency.

According to another embodiment of the present disclosure, counting the number of first pixel points whose gray level values are larger than or equal to a first gray level value and the number of other pixel points whose gray level values are smaller than the first gray level value in an image displayed by a target display comprises:

counting the number of the first pixel points whose gray level values are larger than or equal to the first gray level value and the number of the other pixel points whose gray level values are smaller than the first gray level value in the image displayed by the target display in a preset period.

According to another embodiment of the present disclosure, the method of operating a display driving device further comprises:

setting a refresh frequency of the target display.

The technical solutions of the present disclosure have been illustrated in detail with reference to the drawings. Through the above technical solutions, the refresh frequency of the display device can be reduced in the case of almost not influencing the viewing effect of the user, thereby reducing the power consumption of the display.

In the present disclosure, the terms such as "first", "second", "third" are only used for describing purpose, and could not be understood as indicating or implying relative importance. The term "a plurality of" refer to two or more than two, unless otherwise specified.

What are stated above are only exemplary embodiments of the present disclosure, which are not used for limiting the present disclosure. For the skilled person in the art, various modifications and variations can be made to the present disclosure. Any amendment, equivalent replacement and improvement made within the spirit and the principle of the present disclosure should be encompassed within the protection scope of the present disclosure.

The invention claimed is:

1. A display driving device, comprising: a counting unit, a comparing unit and a driving unit, wherein the counting unit is configured to count a number of first pixel points whose gray level values are larger than or equal to a first gray level value and a number of other pixel points whose gray level values are smaller than the first gray level value in an image displayed by a target display; the comparing unit is configured to compare the number of the first pixel points and the number of the other pixel points, and transmit a first instruction to the driving unit if the number of the first pixel points is larger than or equal to the number of the other pixel points; the driving unit is configured to, if the first instruction is received, control a refresh frequency of the target display to be larger than or equal to a first frequency, otherwise, control the refresh frequency of the target display to be smaller than the first frequency, wherein the counting unit is further configured to count a number of second pixel points whose gray level values are smaller than the first gray level value and larger than or equal to a second gray level value, a number of third pixel points whose gray level values are smaller than the second gray level value and larger than or equal to a third gray level value, and a number of Nth pixel points whose gray level values are smaller than an N−1th gray level value and larger than or equal to an Nth gray level value, wherein the first gray level value is larger than the second gray level value, the second gray level value is larger than the third gray level value, the third gray level value is larger than the N−1th gray level value, and the N−1th gray level value is larger than the Nth gray level value; the comparing unit is further configured to compare the numbers of the first to Nth pixel points, and transmit an nth instruction to the driving unit if a number of nth pixel points is the largest in the numbers of the first to the Nth pixel points; the driving unit is further configured to, if the nth instruction is received, control the target display to be refreshed at an nth frequency, wherein n and N are positive integers, and $1<n\leq N$, $N>1$, an n−1th frequency is larger than the nth frequency.

2. The display driving device according to claim 1, wherein a difference value between the n−1th frequency and the nth frequency is larger than or equal to a difference value between the nth frequency and an n+1th frequency.

3. The display driving device according to claim 1, wherein N=4, the first gray level value is larger than 190 and smaller than 200, the second gray level value is larger than 120 and smaller than 130, the third gray level value is larger than 60 and smaller than 70.

4. The display driving device according to claim 3, wherein the first gray level value is equal to 192, the second gray level value is equal to 127, and the third gray level value is equal to 63, and wherein a first refresh frequency is equal to 60 Hz, a second refresh frequency is equal to 50 Hz, a third refresh frequency is equal to 42 Hz, and a fourth refresh frequency is equal to 36 Hz.

5. The display driving device according to claim 1, wherein N=3, the first gray level value is larger than 190 and smaller than 200, and the second gray level value is larger than 120 and smaller than 130.

6. The display driving device according to claim 5, wherein the first gray level value is equal to 192, and the second gray level value is equal to 127, and wherein a first refresh frequency is equal to 60 Hz, a second refresh frequency is equal to 50 Hz, and a third refresh frequency is equal to 42 Hz.

7. The display driving device according to claim 1, wherein N=2, the first gray level value is larger than 190 and smaller than 200.

8. The display driving device according to claim 7, wherein the first gray level value is equal to 192, and a first refresh frequency is equal to 60 Hz.

9. The display driving device according to claim 1, wherein the counting unit counts the number of the first pixel points whose gray level values are larger than or equal to the first gray level value and the number of the other pixel points whose gray level values are smaller than the first gray level value in the image displayed by the target display in a preset period.

10. The display driving device according to claim 1, further comprising:

a frequency selecting unit for setting a refresh frequency of the target display.

11. A display device comprising a display panel and a display driving device, wherein the display driving device comprises: a counting unit, a comparing unit and a driving unit; wherein the counting unit is configured to count a number of first pixel points whose gray level values are larger than or equal to a first gray level value and a number of other pixel points whose gray level values are smaller than the first gray level value in an image displayed by a target display; the comparing unit is configured to compare the number of the first pixel points and the number of the other pixel points, and transmit a first instruction to the driving unit if the number of the first pixel points is larger than or equal to the number of the other pixel points; the driving unit is configured to, if the first instruction is received, control a refresh frequency of the target display to be larger than or equal to a first frequency, otherwise, control the refresh frequency of the target display to be smaller than the first frequency, wherein the counting unit is further configured to count a number of second pixel points whose gray level values are smaller than the first gray level value and larger than or equal to a second gray level value, a number of third pixel points whose gray level values are smaller than the second gray level value and larger than or equal to a third gray level value, and a number of Nth pixel points whose gray level values are smaller than an N−1th gray level value and larger than or equal to an Nth gray level value, wherein the first gray level value is larger than the second gray level value, the second gray level value is larger than the third gray level value, the third gray level value is larger than the N−1th gray level value, and the N−1th gray level value is larger than the Nth gray level value; the comparing unit is further configured to compare the numbers of the first to Nth pixel points, and transmit an nth instruction to the driving unit if a number of nth pixel points is the largest in the numbers of the first to the Nth pixel points; the driving unit is further configured to, if the nth instruction is received, control the target display to be refreshed at an nth frequency, wherein n and N are positive integers, and $1<n\leq N$, $N>1$, an n−1th frequency is larger than the nth frequency.

12. The display device according to claim 11, wherein a difference value between the n−1th frequency and the nth frequency is larger than or equal to a difference value between the nth frequency and an n+1th frequency.

13. The display device according to claim 11, wherein N=4, the first gray level value is larger than 190 and smaller than 200, the second gray level value is larger than 120 and smaller than 130, the third gray level value is larger than 60 and smaller than 70.

14. A method of operating a display driving device, comprising: counting a number of first pixel points whose gray level values are larger than or equal to a first gray level value and a number of other pixel points whose gray level values are smaller than the first gray level value in an image displayed by a target display; comparing the number of the first pixel points and the number of the other pixel points, and generating a first instruction if the number of the first pixel points is larger than or equal to the number of the other pixel points; controlling a refresh frequency of the target display to be larger than or equal to a first frequency if the first instruction is generated, otherwise, controlling the refresh frequency of the target display to be smaller than the first frequency; counting a number of second pixel points whose gray level values are smaller than the first gray level value and larger than or equal to a second gray level value, a number of third pixel points whose gray level values are smaller than the second gray level value and larger than or equal to a third gray level value, and a number of Nth pixel points whose gray level values are smaller than an N−1th gray level value and larger than or equal to an Nth gray level value, wherein the first gray level value is larger than the second gray level value, the second gray level value is larger than the third gray level value, the third gray level value is larger than the N−1th gray level value, and the N−1th gray level value is larger than the Nth gray level value; comparing the numbers of the first to Nth pixel points, and generating an nth instruction if a number of nth pixel points is the largest in the numbers of the first to the Nth pixel points; controlling the target display to be refreshed at an nth frequency if the nth instruction is generated, wherein n and N are positive integers, and $1<n\leq N$, $N>1$, an n−1th frequency is larger than the nth frequency.

15. The method of operating a display driving device according to claim 14, wherein a difference value between the n−1th frequency and the nth frequency is larger than or equal to a difference value between the nth frequency and an n+1th frequency.

16. The method of operating a display driving device according to claim 14, wherein counting the number of first pixel points whose gray level values are larger than or equal to a first gray level value and the number of other pixel points whose gray level values are smaller than the first gray level value in an image displayed by a target display comprises:

counting the number of the first pixel points whose gray level values are larger than or equal to the first gray level value and the number of the other pixel points whose gray level values are smaller than the first gray level value in the image displayed by the target display in a preset period.

17. The method of operating a display driving device according to claim 14, further comprising:

setting a refresh frequency of the target display.

* * * * *